United States Patent [19]

Patitsas et al.

[11] Patent Number: 4,607,675

[45] Date of Patent: Aug. 26, 1986

[54] LUBRICANT FOR RUN-FLAT TIRE APPLICATION AND RUN-FLAT TIRE THEREWITH

[75] Inventors: George P. Patitsas, Kent; Herbert N. Kagarise, Uniontown, both of Ohio

[73] Assignee: The Goodyear Tire & Rubber Company, Akron, Ohio

[21] Appl. No.: 730,611

[22] Filed: May 6, 1985

[51] Int. Cl.[4] ..... C10M 3/18; C10M 5/02; C10M 7/08; B60C 5/00

[52] U.S. Cl. ..... 152/521; 152/504; 252/21; 252/28; 252/42; 252/58

[58] Field of Search ..... 152/521, 503, 508, 375, 152/378, 379.3; 252/21, 28, 42, 48.5, 52 P, 56 R, 58

[56] References Cited

U.S. PATENT DOCUMENTS

| | | | |
|---|---|---|---|
| 3,910,334 | 10/1975 | Gardner | 152/503 |
| 4,036,765 | 7/1977 | Conger et al. | 152/521 |
| 4,401,144 | 8/1983 | Wilde | 152/521 |

*Primary Examiner*—Michael Ball
*Attorney, Agent, or Firm*—H. C. Young, Jr.

[57] ABSTRACT

A lubricant composition comprised of (A) fatty acid, (B) polytetrafluoroethylene fluorocarbon resin powder (C) pyrogenic amorphous silica powder and (D) carrier. The lubricant is prescribed for use with a pneumatic tire and wheel assembly containing a run-flat device. The lubricant is contemplated as a component in such an assembly.

11 Claims, No Drawings

LUBRICANT FOR RUN-FLAT TIRE APPLICATION AND RUN-FLAT TIRE THEREWITH

FIELD OF INVENTION

This invention relates to a lubricant for use with a pneumatic tire and wheel assembly containing a run flat device to permit the tire to run for a period of time in a deflated condition. The invention relates to such a lubricant which functions primarily when the tire is being operated in a deflated condition.

BACKGROUND

It is often desired to provide tires for vehicles that can be operated in a deflated condition for a suitable distance at a desired speed. The purposes have been varied, ranging from a desire to eliminate a vehicular spare tire so that its occupied space could be more efficiently used for other purposes and, also, a desire to enable a vehicle to remain operable even with a punctured pneumatic tire for a suitable time or distance whether or not a spare tire is available.

In some instances, such objectives have been proposed to be accomplished by providing a multiple chambered tire and also by positioning a run-flat device within the tire-wheel cavity to prevent the tire, upon an appreciable loss of internal inflation pressure, from going completely flat. Such run-flat devices can be substantially rigid in nature and prevent a total collapse of the tire by supporting the tire's inner surface in its crown region in proximity of the ground contacting portion. In such condition, the tire is prevented from going flat against its rim and, moreover, substantially retains its inflated circumferential shape and enables its vehicle to continue its travel over a more reasonable distance.

Examples of various tire assemblies might be visualized with their mechanical features in British Pat. Nos. 1,359,469 and 835,334 and U.S. Pat. No. 3,828,836.

However, it is considered necessary to provide lubricity at the interface between the run-flat device and a collapsing tire's inner surface in order to retard or reduce an attendant potential frictional, destructive heat build up at the tire's inner surface. Accordingly, it is often desired to provide a lubricant for such innerface.

A lubricant for tires containing internal run-flat devices is described in U.S. Pat. No. 4,036,765 as being a gel which is essentially solid or non-flowing at a tire's operating temperature such as below 70° C. but becomes flowable at 90° C. or higher. Such lubricant composition is described as comprising selected amounts of a fatty acid, an alkali or alkaline metal soap and a carrier in which the soap has appreciable solubility but the fatty acid is essentially insoluble. The carrier is described as being comprised of at least one of polypropylene ether glycol/triol, polyethylene ether glycol/triol and water and ethylene glycol and its lower homologs.

Although the gel of U.S. Pat. No. 4,036,765 is satisfactory for many purposes, and has been observed that, in order to provide sufficient lubricity, it remains desired to provide a lubricant of adequate lubricity which is not corrosive toward some types of metallic run-flat devices which are positioned within the pneumatic tire cavity to prevent the tire from going completely flat upon reduction of its internal pressure.

DISCLOSURE AND PRACTICE OF THE INVENTION

In accordance with this invention, a lubricant composition comprises a composite mixture of (A) about 2 to about 60 parts of a fatty acid having from 12 to 24 carbon atoms, (B) about 2 to about 20 parts by weight of a polytetrafluoroethylene fluorocarbon resin powder, (C) about 10 to about 20 parts pyrogenic amorphous silica powder and (D) about 40 to about 100 parts of a carrier selected from at least one of water, polypropylene ether glycol and/or triol having a molecular weight in the range of about 400 to about 3500, polyethylene ether glycol and/or triol having a molecular weight in the range of about 400 to about 3800, and polyols containing 2 to 4, preferably 2 to 3, hydroxyl groups with a molecular weight of less than 400.

In the practice of this invention, it is often desired to also provide about one to about 50 parts by weight of an surfactant such as, for example, an alkylaryl polyether surfactant for the purpose of aiding in the wetting the surface of the polytetrafluoroethylene fluorocarbon resin powder. A non-ionic alkylaryl polyether surfactant has been found to be suitable for this purpose. Although the amount of surfactant, if used, is not critical, usually a resin-wetting amount is used under the circumstances.

The lubricant of this invention typically is sufficiently viscous that it is essentially solid or non-flowable below 70° C. by gravity force under its own weight on an inclined surface and flowable slowly at temperatures higher than 90° C. without application of sheer force. It has been observed, however, that the lubricant can be made to flow at temperatures less than 70° C. by application of a sheer force.

It is important to appreciate that the lubricant of this invention differs primarily from the lubricant gel of U.S. Pat. No. 4,036,765 in that the said metal soap of a fatty acid required in the said patented lubricant is withdrawn and component resin (B) is added. An optional surfactant is also identified for use with component resin (B). In addition, the patent's optional pyrogenic silica is now a required component (C) of this invention.

In the practice of this invention, various fatty acids (A) can be used representative examples of which are stearic acid, oleic acid, palmitic acid and pelargonic acid.

The polytetrafluoroethylene fluorocarbon resin is used in a powder form. Such resin is known to possess lubricating properties for some applications. An example of such resin is Teflon, a trademark of the du Pont de Nemours Company. The particulate resin desirably has a particle size of less than about 50, and preferably less than about 30 microns.

The pyrogenic silica is used in a powder form. Such silica is well known and is useful for many purposes. The particulate silica desirably has a particle size of less than about 30 millimicrons. An example of such silica is Cab-O-sil, trademark of the Cabot Corporation, relating to colloidal silica particles sintered together apparently in chain-like formations.

In the further practice of this invention, the carrier desirably is selected in which the fatty acid is substantially insoluble with proportions being adjusted to give an apparent gel at temperatures less than about 70° C. yet provide a fluid composition at temperatures of 90° C. or higher. The polyol used for the carrier may be, for example, selected from ethylene glycol, diethylene glycol, triethylene glycol and glycerol. In general, the polyol to fatty acid weight ratio may generally be in the range from about 3/1 to about 10/1.

In the practice of this invention, it has been observed that the lubricant composition prescribed herein has been advantageously beneficial over the described prior lubricant gel of Example II of U.S. Pat. No. 4,036,765 in that it has been observed to be easier to process and handle during its preparation and application, it has demonstrated a lower corrosion effect on rigid, magnesium metal run-flat devices and moreover, the lubricant has enabled the deflated tire to run longer under deflated conditions against its internal run-flat device. In addition, the rheological characteristics of the lubricant were observed to demonstrate a lower viscosity under applied sheer conditions, and thus could be more easily pumped and applied to a suitable substrate.

In general, the lubricants of this invention can be prepared by mixing the fatty acid and the powdered tetrafluoroethylene fluorocarbon resin and silica with the desired amount of carrier at a temperature of about 70° C. up to a temperature where a fluid mixture can be obtained. The lubricant prepared in the such manner can subsequently be melted at a temperature of approximately 90° C. or higher and distributed uniformly around the interior of the tire and allowed to congeal or gel and the treated tire mounted on a rim of a wheel in a conventional manner using an internal safety member (such as a run-flat device), as desired, with this wheel and tire assembly. Alternatively, the lubricant can be packaged and positioned within the rim/tire cavity. Then the wheel and tire assembly is mounted on the automobile or vehicle in the conventional manner with the tire being inflated at a conventional pressure recommended for a service to which the tire will be subjected.

In one aspect, the lubricant can be prepared by the steps of (a) heating a carrier of water and polyol to a temperature of at least about 70° C., (b) melting in the fatty acid with the carrier, and (c) mixing in the silica, teflon powder and surfactant to achieve a melt. The melt can be either (1) stored, (2) packaged, or (3) applied to a suitable substrate and upon cooling becomes a gel primarily because of the combination of the silica, melting points of the components (acid) and the lower solubility of the acid in the water/polyol carrier at lower temperatures.

Thus, in the practice of this invention, the lubricant constitutes a component of an assembly composed of a pneumatic tire mounted on a supporting rim, said assembly containing a run-flat device within said tire and attached to said rim, wherein said lubricant is positioned in said assembly to provide lubricity between the said run-flat device and the inner surface of said tire upon the tire becoming deflated. Accordingly, an assembly of a pneumatic tire mounted on a supporting rim containing a run-flat device within said tire and attached to said rim is provided wherein said assembly contains the lubricant of this invention positioned therein to provide lubricity between said run-flat device and inner surface of said tire upon the tire being deflated.

In the practice of this invention, it has been observed that a tire, upon deflating against its run-flat device, such as by puncture, may eventually reach a temperature in the range of 300°–350° F. (150°–175° C.) in which a substantial degradation of the tire's surface begins to occur. The importance of this invention is that the lubricant prolongs the time until the tire's surface reaches such temperature range and therefore delays its eventual failure. Under tests, it has been observed that a deflated tire with an internal run-flat device, which would normally fail after about two miles of travel in it deflated condition before appreciable tire degradation would occur, could be driven a distance of over 30 miles until tire failure, depending somewhat upon atmospheric ambient temperatures.

The nature of this invention can be more readily appreciated and its advantages understood from the following examples wherein all parts and percentages are by weight unless otherwise indicated.

EXAMPLE I

A lubricant (X) according to this invention and a lubricant (Y) according to U.S. Pat. No. 4,036,765 (Example II) were prepared according to the recipes shown in the following Tables 1 and 2.

TABLE 1

(Lubricant X of this invention)

| Material | Parts |
|---|---|
| Polypropylene glycol (1000 mw) | 100 |
| Stearic acid | 20 |
| Non-ionic alkyl aryl polyether surfactant)[1] | 2 |
| Pyrogenic silica) powder[2] | 10 |
| Polytetrafluoroethylene fluorocarbon resin powder[3] | 5 |
| Heat stabilizer (styrenated diphenylamine)[4] | 4 |
| Total | 141 |

[1]Triton CF-10 from The Rohm & Haas Co.
[2]Cab-O-sil M-5 from The Cabot Corp.
[3]Polymist F5A from the Allied Chemical Corp.
[4]Wingstay 29 from the Goodyear Tire & Rubber Company

TABLE 2

Lubricant (Y) Representing Example II of U.S. Pat. No. 4,036,765

| Materials | Parts |
|---|---|
| Polypropylene glycol (1000 mw) | 100 |
| Stearic acid | 20 |
| Sodium stearate | 9 |

The lubricant (X) was prepared by heating the polypropylene glycol to 70° C. and adding the stearic acid with agitation and continuing the mixing until the stearic acid is melted. The rest of the ingredients are then added while mixing.

The lubricant (Y) was prepared by heating the polypropylene glycol to 70° C. and then adding the other two ingredients with continuous mixing until a homogeneous fluid was obtained.

EXAMPLE II (Coefficients of Friction)

Coefficients of friction between cured sheets of tire innerliner rubber stock (blend of chlorobutyl, natural rubber and polybutadiene) coated with the run-flat lubricants (X) and (Y) against a 4"×¼" (10.2 cm×0.6 cm) block of magnesium were determined to be as follows:

| | Lubricant (Y) | Lubricant (X) |
|---|---|---|
| Coefficient of Friction at 75° F. (24° C.) | 0.13 | 0.12 |
| Coefficient of Friction at 200° F. (94° C.) | 0.05 | 0.02 |

EXAMPLE III (Corrosion Test)

Plates of bare unpainted steel and sanded magnesium having dimension of 1×3 inches (2.54×7.6 cm) and a thickness of 0.125 inch (0.3 cm) were coated, individually with lubricants (X) and (Y). Control samples of the steel plates having no lubricant coating were also prepared.

The samples were tested using the Goodyear Reflux accelerated corrosion test which is intended to simulate humid and high-temperature conditions inside of a tire. According to the test procedure each sample is positioned below a water-cooled condenser. Also, beneath the condenser, a flask of distilled water is positioned on a hot plate with the temperature of the hot plate being slowly raised until the water begins to boil. The distilled water liquid and vapor mixture is refluxed over the positioned sample for a period of 14 days. At the end of this test, the samples are compared for corrosion and erosion both (A) visually and (B) by photographing the samples through an enlarger with a magnification four times the actual size. The observed comparisons are shown in the following Table 3.

TABLE 3

| | Rating[1] |
|---|---|
| Unpainted Steel | |
| Plate coated with lubricant (X) | 5 |
| Plate coated with lubricant (Y) | 6 |
| Control plate (no lubricant) | 8 |
| Sanded Magnesium | |
| Plate coated with lubricant (X) | 2 |
| Plate coated with lubricant (Y) | 5 |
| Control plate (no lubricant) | 1 |

[1]A rating on a scale of 1 through 10 with 1 representing the best appearance and 10 representing the worst appearance.

EXAMPLE IV (Rheological Characteristics)

The lubricant of the present invention (Lubricant X) shows better rheological characteristics than the lubricant Y, because it shows thixotropic behavior. Under low shear rate conditions, it does not flow, but it offers low resistance to flow. The lubricant Y, however, is a solid at ambient conditions, but melts at 92° C. (198° F.), and its viscosity drops very rapidly. Since tires often reached 92° C. during running conditions of the test, the lubricant Y melted and accumulated at the lowest point of the tire, creating an unbalanced tire.

The lubricant of the present invention (Lubricant X) was observed to be easier to pump and apply into the tire, but once applied, it stayed in place during normal running conditions.

EXAMPLE V (Tire Performance)

Pneumatic rubber tires of size 36.5×12.5-16.5 were mounted on metal rims having been fitted with magnesium run-flat devices. The tires were inflated and fitted on a suitable vehicle. The tires were punctured and allowed to deflate so that the inner surface of the crown portion of the tire adjacent the ground contacting portion of the tire came in contact with the magnesium run-flat device so that the run-flat device actually rested on the inner surface.

The tires, after puncture, were run under load, at a speed of about 30 mph until failure. The ambient temperature during the test was about 70°-75° F. (about 22° C.). The distance run until tire failure is shown in the following Table V which indicates that the tire containing lubricant (X) ran about 18 percent further before failure. Typically, such tire assembly without any added lubricant (X or Y) would be expected to run about 2 miles until failure.

TABLE V

| | Distance to failure |
|---|---|
| Tire containing lubricant (X) | 30.3 miles (48 km) |
| Tire containing lubricant (Y) | 25.6 miles (41 km) |

While certain representative embodiments and details have been shown for the purpose of illustrating the invention, it will be apparent to those skilled in this art that various changes and modifications may be made therein without departing from the spirit or scope of the invention.

What is claimed is:

1. A lubricant composition which comprises a composite mixture of (A) about 2 to about 60 parts of a fatty acid having from 12 to 24 carbon atoms, (B) about 2 to about 20 parts by weight of a polytetrafluoroethylene fluorocarbon resin powder, (C) about 10 to about 20 parts pyrogenic amorphous silica powder and (D) about 40 to about 100 parts of a carrier selected from at least one of water, polypropylene ether glycol and/or triol having a molecular weight in the range of about 400 to about 3500, polyethylene ether polyol and/or triol having a molecular weight in the range of about 400 to about 3800, and polyols containing 2 to 4 hydroxyl groups with a molecular weight of less than 400.

2. The lubricant of claim 1 characterized by essentially non-flowable below 70° C. by gravity force on an inclined surface and flowable slowly at temperatures higher than 90° C.

3. The lubricant of claim 1 where the fatty acid is selected from at least one of stearic acid, oleic acid, palmitic acid and pelargonic acid.

4. The lubricant of claim 1 where the said polyol is selected from at least one of ethylene glycol, polypropylene glycol and glycerol.

5. The lubricant of claim 1 where the carrier is water.

6. The lubricant of claim 1 where the carrier is at least one of polyethylene ether glycol and polypropylene ether glycol.

7. The lubricant of claim 1 which contains about one to about 50 parts by weight of a surfactant.

8. The lubricant of claim 7 which comprises a mixture of (A) at least one fatty acid selected from stearic acid, oleic acid, palmitic acid and pelargonic acid, (B) polytetrafluoroethylene fluorocarbon powder having a particle size of less than about 30 microns, (C) pyrogenic amorphous silica powder having a particle size of less than about 30 millimicrons, (D) surfactant, and (E) a carrier of at least one of water, polypropylene ether glycol and/or triol polyethylene ether glycol and/or triol, ethylene glycol and glycerol.

9. The lubricant of claim 7 where the surfactant is a non-ionic alkyl aryl polyether and where the weight ratio of polyol (E) to fatty acid (A) is in the range of about 3/1 to about 10/1.

10. The lubricant of claim 8 prepared by the steps of (A) heating the carrier to a temperature to at least about 70° C., (B) melting in the fatty acid with the carrier and (C) mixing the silica, polytetrafluoroethylene fluorocarbon resin and surfactant to achieve a melt.

11. The lubricant of claim 8 as a component of an assembly composed of a pneumatic tire mounted on a supporting rim, said assembly containing a run-flat device within said tire and attached to said rim wherein said lubricant is positioned in said assembly to provide lubricity between the said run-flat device and the inner surface of said tire upon the tire becoming deflated.

* * * * *